US005196091A

United States Patent [19]

Hergert

[11] Patent Number: 5,196,091

[45] Date of Patent: Mar. 23, 1993

[54] HEADBOX APPARATUS WITH STOCK DILUTION CONDUITS FOR BASIS WEIGHT CONTROL

[75] Inventor: Richard E. Hergert, Rockton, Ill.

[73] Assignee: Beloit Technologies, Inc., Wilmington, Del.

[21] Appl. No.: 784,288

[22] Filed: Oct. 29, 1991

[51] Int. Cl.[5] ..... D21F 1/08

[52] U.S. Cl. ..... 162/258; 162/259; 162/343

[58] Field of Search ..... 162/258, 259, 336, 343

[56] References Cited

U.S. PATENT DOCUMENTS

| | | | |
|---|---|---|---|
| 3,407,114 | 10/1968 | Springuel | 162/341 |
| 3,547,775 | 12/1970 | Bossen et al. | 162/336 |
| 3,791,918 | 2/1974 | Koskimies et al. | 162/343 |
| 4,539,075 | 9/1985 | Majaniemi | 162/336 |
| 4,898,643 | 2/1990 | Weisshuhn et al. | 162/259 |
| 4,909,904 | 3/1990 | Kinzler | 162/343 |
| 5,030,326 | 7/1991 | Nous | 162/258 |

FOREIGN PATENT DOCUMENTS

| | | | |
|---|---|---|---|
| 89/11561 | 11/1989 | PCT Int'l Appl. | 162/343 |

*Primary Examiner*—Karen M. Hastings

*Attorney, Agent, or Firm*—Dirk J. Veneman; Raymond W. Campbell; David J. Archer

[57] ABSTRACT

A headbox apparatus is disclosed for ejecting stock onto a forming wire for forming a web. The apparatus includes a housing which is connected to a pressurized source of the stock. The housing defines a tapered inlet for the flow therethrough of the stock. The tube bank has an upstream and a downstream end with the upstream end being connected to the tapered inlet such that the stock flows at a substantially constant flow rate through the inlet and through the upstream end of the tube bank to the downstream end of the tube bank. The tube bank includes a plurality of tubes for the flow therethrough of the stock. A member defines a slice chamber which has an upstream and a downstream extremity. The upstream extremity is connected to the downstream end of the tube bank, and the downstream extremity is disposed adjacent to the forming wire. The arrangement is such that the stock flows through the downstream end of the tube bank and through the upstream extremity of the slice chamber so that the stock is ejected from the downstream extremity of the slice chamber onto the forming wire. A plurality of supply conduits are connected to the upstream end of the tube back with each supply conduit being connected to a stock diluting source for permitting diluton of the stock flowing into the tube bank. A control device cooperates with the supply conduits for controlling the dilution of the stock flowing through at least some of the tubes of the tube bank for controlling the cross-machine directional basis weight of the resultant web.

10 Claims, 3 Drawing Sheets

HEADBOX APPARATUS WITH STOCK DILUTION CONDUITS FOR BASIS WEIGHT CONTROL

BACKGROUND OF THE INVENTION FIELD OF THE INVENTION

The present invention relates to a headbox apparatus for ejecting stock onto a forming wire for forming a web. More particularly, the present invention relates to a headbox having means for diluting the stock for controlling the cross-machine directional basis weight of the resultant web.

INFORMATION DISCLOSURE STATEMENT

In the papermaking art, stock is ejected from a headbox onto a fourdrinier forming wire which moves at approximately the same speed as the ribbon of stock being ejected from the headbox. Water drains from the stock through the forming wire so that a web is formed on the forming wire.

More specifically, the stock is supplied at extremely high pressure to the headbox by means of pumping equipment so that the stock is ejected from the headbox through a slice lip.

An attentuator is disposed upstream relative to the headbox for damping pressure pulses caused by the stock pumping equipment. The arrangement is such that the rate of flow of stock entering the headbox is relatively constant.

Typically, the headbox inlet, or inlet header, is of tapered configuration. Such tapered inlet is required for the reason stated hereinafter. The stock flows from the tapered inlet through a plurality of distributor tubes disposed within a tube bank. Accordingly, it is essential that the rate of flow of stock through a distributor tube disposed at one side of the headbox be the same as the rate of flow of stock moving through a distributor tube disposed at the opposite side of the headbox.

More particularly, the rate of flow of stock is, for example, the number of cubic feet of the stock passing a particular point every minute. Moreover, it is necessary in a headbox that such rate of flow remain constant or as constant as possible throughout the headbox. The basic reason why the rate of flow should remain constant is that if the stock during preparation has been thoroughly mixed, and if the slice lip opening is the same along the entire cross-machine directional width of the headbox, the weight of the fibers within the stock per inch of width across the ribbon of stock ejected through the slice lip will be constant. Accordingly, the resultant web will have a uniform basis weight in a cross-machine direction.

In order to achieve such constant flow rate, the inlet header is tapered in a cross-machine direction so that the cross-sectional area of the inlet header is reduced by an area substantially equal to three times the total cross-sectional area of the tubes of the tube bank immediately upstream of the cross-sectional area of the header. That is, part of the main flow of stock flowing through the inlet header flows through a vertical tier of tubes. Therefore, the inlet is reduced in area by an amount substantially equivalent to three times the cross-sectional area of the tier of tubes in order to compensate for the loss of the diverted flow, thereby maintaining the same pressure in the header in the cross-machine direction to maintain the same flow through the tubes in the cross-machine direction.

Consequently, the rate of flow of stock through all the tubes in a cross-machine direction is maintained substantially constant.

However, in practice, it is very difficult to maintain a constant stock supply pressure due to pressure pulses of the pumping equipment and the inability of the pressure attenuators to completely dampen out such pressure pulses.

Accordingly, various proposals have been disclosed for recirculating stock from the side of the inlet header opposite to the supply port of the inlet.

Nevertheless, variations in the rate of flow of stock through the distributor tubes is almost impossible to eliminate.

Furthermore, the maintenance of a completely even distribution of fibers within the stock present problems when endeavoring to maintain a uniform basis weight across the width of a formed web.

Consequently, typical prior art headboxes include relatively complex mechanisms for adjusting or warping the upper slice lip of a headbox in order to vary in a cross-machine direction the volume of stock per minute ejected from the headbox.

By varying the opening of the headbox slice at a particular point along the length thereof in a cross-machine direction, the weight of stock ejected per minute can be adjusted in a cross-machine direction so as to compensate for the aforementioned non-uniform rates of flow of stock and for such uneven distribution of fibers within the stock.

Nevertheless, not only are the aforementioned proposals mechanically complex but also, when the rate of flow is altered at any one point across the width of a slice lip, such change in the rate of flow inherently affects the rate of flow on either side of such point so that the orientation of fiber; within the stock is adversely affected.

The present invention overcomes the aforementioned problems associated with altering a slice lip of a headbox by selectively diluting the stock flowing through certain of the tubes of the tube bank in order to compensate for variations in the basis weight of stock ejected from the headbox.

In practice, measuring equipment disposed downstream from the headbox continuously measures the basis weight of the web along various points across the cross-machine direction of the web, and if there exists a variation at one particular point, a signal is sent to actuate one or more valves for supplying water, such as, for example, clarified white water, to the required location in order to compensate for the measured non-uniformity in basis weight.

By the introduction of such water, which may be recirculated from the water removed from the fourdrinier wire, the rate of flow within such tube remains equivalent to the rate of flow through adjacent tubes. Such is the case because the diluting water does not introduce an increased pressure in the inlet.

Although U.S. Pat. No. 3,407,114 to Springuel, which issued Oct. 22, 1988, taught controlling the cross-issued machine directional basis weight by the addition of white water to the headbox, such disclosure merely taught adding the white water to the pond of a headbox above the level of the stock as shown in FIG. 2 thereof. No disclosure is made therein of accurately metering a diluting solution to specific tubes of a headbox for accurately controlling the basis weight along the cross-machine directional width of a web.

Therefore, it is a primary objective of the present invention to provide a headbox apparatus which overcomes the aforementioned inadequacies of the prior art proposals and which makes a considerable contribution to the art of evenly distributing stock onto a forming wire.

Another object of the present invention is the provision of a headbox apparatus which includes a plurality of supply conduits connected to an upstream end of a tube bank so that each supply conduit is connected to a stock diluting source for permitting dilution of the stock flowing into the tube bank for controlling the cross-machine directional basis weight of the resultant web.

Other objects and advantages of the present invention will be readily apparent to those skilled in the art by a consideration of the detailed description, taken in conjunction with the annexed drawings.

SUMMARY OF THE INVENTION

The present invention relates to a headbox apparatus and method for ejecting stock onto a forming wire for forming a web. The apparatus includes a housing which is connected to a pressurized source of the stock. The housing defines a tapered inlet for the flow therethrough of the stock.

A tube bank has an upstream and a downstream end with the upstream end of the tube bank being connected to the tapered inlet such that the stock flows at a substantially constant flow rate through the inlet and through the upstream end of the tube bank to the downstream end of the tube bank.

The tube bank includes a plurality of tubes for the flow therethrough of the stock.

A member defines a slice chamber with the slice chamber having an upstream extremity and a downstream extremity. The upstream extremity is connected to the downstream end of the tube bank. The downstream extremity is disposed adjacent to the forming wire such that the stock flows through the downstream end of the tube bank and through the upstream extremity of the slice chamber so that the stock is ejected from the downstream extremity of the slice chamber onto the forming wire.

A plurality of supply conduits are connected to the upstream end of the tube bank. Each supply conduit is connected to a stock diluting source for permitting dilution of the stock flowing into the tube bank.

Control means cooperate with the supply conduits for controlling the dilution of stock flowing through at least some of the tubes of the tube bank for controlling the cross-machine directional basis weight of the resultant web.

In a more specific embodiment of the present invention, the tapered inlet is tapered in a cross-machine direction such that the cross-sectional area for the flow therethrough of the stock progressively varies in a cross-machine direction.

The housing includes an upstream and a downstream port in fluid communication with the tapered inlet. The upstream port is connected to the pressurized source of stock. The cross-sectional area of the tapered inlet is inversely proportional to the distance from the upstream port.

The tube bank also includes a frame for mechanically supporting the plurality of tubes such that the stock flowing through the inlet and through the upstream end of the tube bank flows through the plurality of tubes.

The plurality of tubes are rigidly supported by the frame, and the tubes are arranged in vertically spaced rows. Each tube within each row is vertically aligned relative to a tube of an adjacent row.

Each tube of the plurality of tubes includes an upstream and a downstream portion. The upstream portion defines a substantially circular section taken in a direction normal to the direction of flow of the stock. The downstream portion includes an initial end of circular cross-sectional configuration and an outlet end defining a substantially rectangular cross-sectional configuration for maintaining a substantially constant volumetric flow of stock through the tube while increasing the velocity of the stock flow through the outlet end.

. The slice chamber also includes a plurality of trailing elements. Each trailing element has an end which is pivotally secured to the downstream end of the tube bank. Each trailing element is pivotally secured to the tube bank between adjacent rows of the plurality of rows.

More particularly, the tube bank defines a plurality of dove-tail shaped grooves with each groove being disposed between adjacent rows of the plurality of rows.

Each trailing element defines in the vicinity of the pivotally secured end thereof an enlargement which cooperates with one of the grooves for pivotally anchoring the element within the groove such that the stock flowing through the upstream extremity of the slice chamber is separated into a plurality of streams partitioned from each other by the plurality of trailing elements.

The slice chamber converges in a direction from the upstream extremity to the downstream extremity such that the plurality of streams within the slice chamber converge relative to each other.

The plurality of supply conduits extend through the tube bank between adjacent tubes of the plurality of tubes.

More particularly, each supply conduit extends through the tube bank between adjacent tubes with each conduit having a termination disposed closely adjacent to and upstream relative to an adjacent tube of the plurality of tubes. The termination is disposed adjacent to the upstream end of the tube bank.

The stock diluting source is fresh water or clarified white water removed from the stock through the forming wire. The water flows through the termination such that the water mingles with and dilutes the stock flowing through the adjacent tube without changing the flow rate through the adjacent tube.

The flow of water through the termination is substantially normal to the flow of stock past the termination towards the adjacent tube.

The control means includes a plurality of flow control valves. Each valve cooperates with a conduit such that each of the supply conduits is selectively connected to the stock diluting source for varying the basis weight of the resultant web in a cross-machine direction without changing the flow rate through the tube bank.

Many modifications and variations of the present invention will be readily apparent to those skilled in the art by a consideration of the detailed description contained hereinafter, taken in conjunction with the annexed drawings.

However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
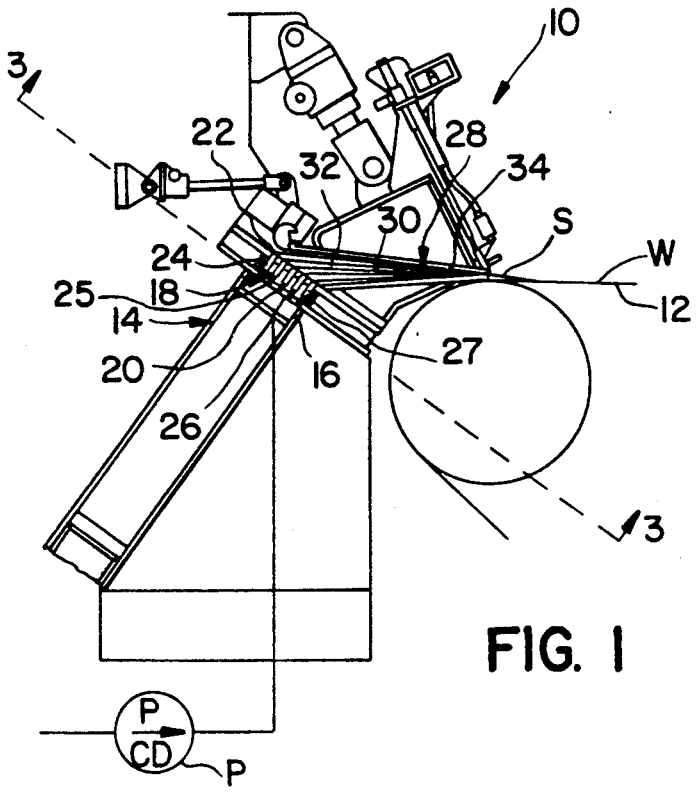
FIG. 1 is a sectional view of a headbox apparatus according to the present invention.

FIG. 1 is a sectional view of a headbox apparatus, generally designated 10 according to the present invention, for ejecting stock S onto a forming wire 12 for forming a web W. The apparatus 10 includes a housing, generally designated 14, which is connected to a pressurized source P of the stock S. The housing 14 defines a tapered inlet 16 for the flow therethrough of the stock S.

A tube bank, generally designated 18, has an upstream and a downstream end 20 and 22, respectively. The upstream end 20 of the tube bank 18 is connected to the tapered inlet 16 such that the stock S flows at a substantially constant flow rate through the inlet 16 and through the upstream end 20 of the tube bank 18 to the downstream end 22 of the tube bank 18.

The tube bank 18 includes a plurality of tubes 24,25,26 and 27 for the flow therethrough of the stock S.

A member, generally designated 28, defines a slice chamber 30. The slice chamber has an upstream extremity 32 and a downstream extremity 34. The upstream extremity 32 is connected to the downstream end 22 of the tube bank 18. The downstream extremity 34 is disposed adjacent to the forming wire 12 such that the stock S flows through the downstream end 22 of the tube bank 18 and through the upstream extremity 32 of the slice chamber 30 so that the stock S is ejected from the downstream extremity 34 of the slice chamber 30 onto the forming wire 12.

Figure 2:
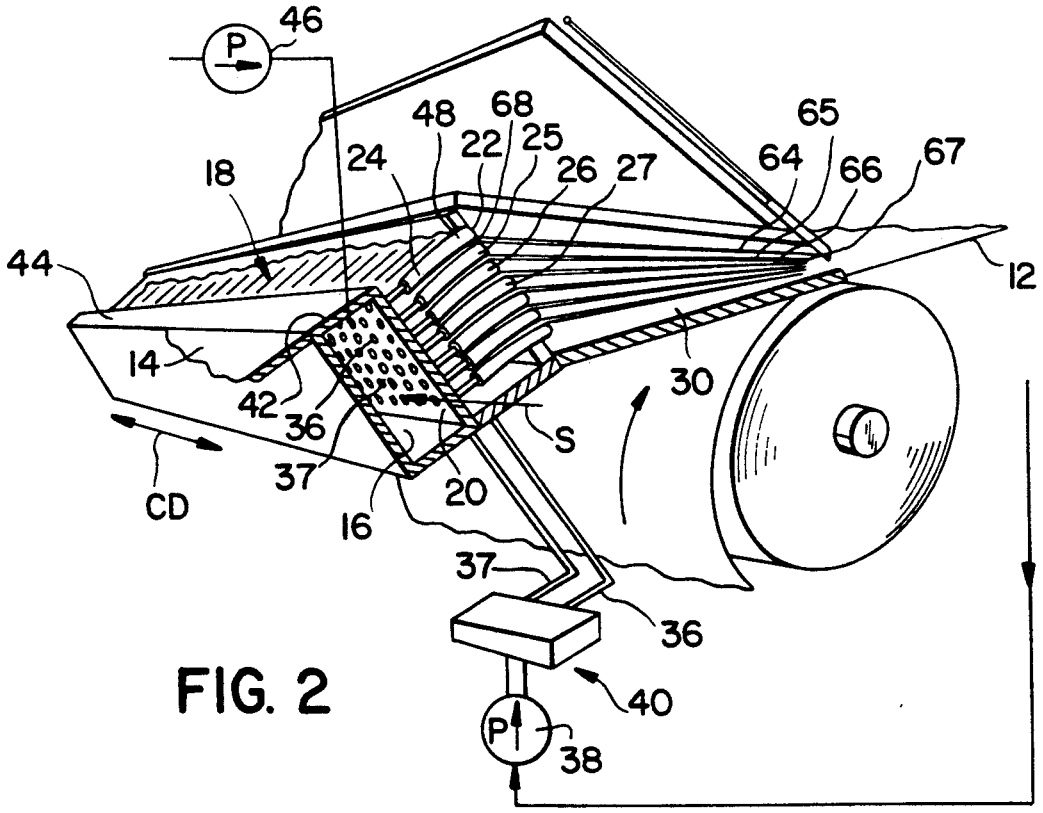
FIG. 2 is an enlarged perspective view, partially in section, of the headbox apparatus shown in FIG. 1.

FIG. 2 is a perspective view of the inlet 16, tube bank 18 and slice chamber 30.

As shown in FIG. 2, a plurality of supply conduits 36 and 37 are connected to the upstream end 20 of the tube bank 18. Each supply conduit 36 and 37 of the plurality of supply conduits are connected to a stock diluting source 38 for permitting dilution of the stock S flowing into the tube bank 18.

Control means, generally designated 40, cooperate with the supply conduits 36 and 37 for controlling the dilution of the stock S flowing through at least some of the tubes 36 and 37 of the tube bank 18 for controlling the cross-machine directional basis weight of the resultant web.

The tapered inlet 16 is tapered in a cross-machine direction, as indicated by the arrow CD, such that the cross-sectional area for the flow therethrough of the stock progressively varies in a cross-machine direction.

More specifically, the housing 14 includes an upstream and a downstream port 42 and 44, respectively, in fluid communication with the tapered inlet 16. The upstream port 42 is connected to a pressurized source P of the stock S, as shown in FIG. 1. The cross-sectional area of the tapered inlet 16 is inversely proportional to the distance from the upstream port 42.

The tube bank 18 also includes a frame 48 for mechanically supporting the plurality of tubes 24 to 27 such that the stock flowing through the inlet 16 and through the upstream end 20 of the tube bank 18 flows through the plurality of tubes 24 to 27.

Figure 3:
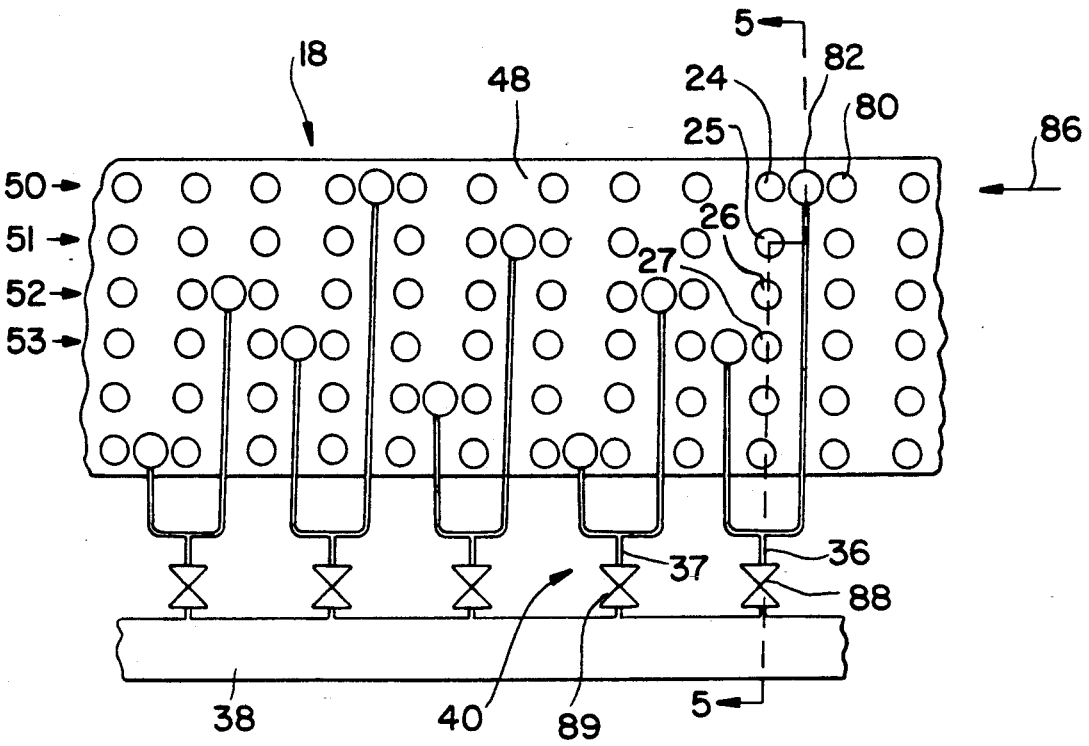
FIG. 3 is a sectional view taken on the line 3—3 of FIG. 1.

FIG. 3 is a sectional view taken on the line 3—3 of FIG. 1.

FIG. 3 shows the plurality of tubes 24 to 27 rigidly supported by the frame 48. Furthermore, the tubes 24 to 27 are arranged in vertically spaced rows 50,51,52 and 53. The tube 26, for example, is disposed within the row 52, and the tube 26 is vertically aligned relative to the tube 27 of row 53.

Figure 4:
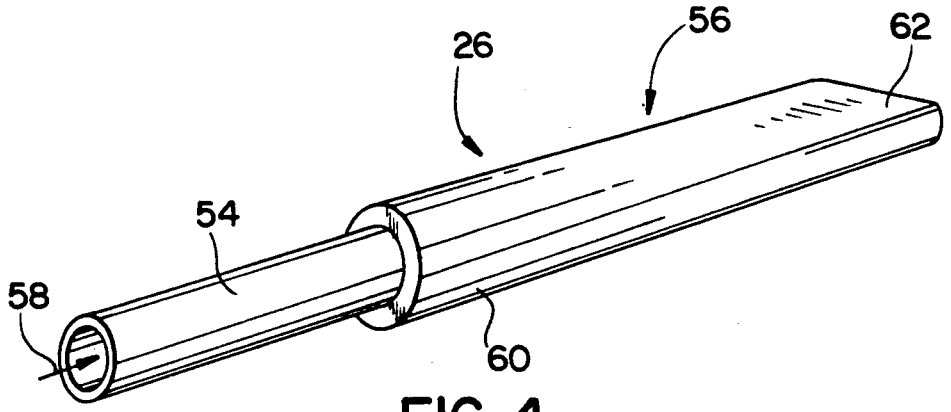
FIG. 4 is an enlarged perspective view of one of the tubes shown in FIG. 1.

FIG. 4 is a perspective view of one of the tubes 26. As shown in FIG. 4, the tube 26 includes an upstream and a downstream portion 54 and 56. The upstream portion 54 defines a substantially circular section taken in a direction normal to the direction of flow, as indicated by the arrow 58, of the stock. The downstream portion 56 has an initial end 60 of circular cross-sectional configuration and an outlet end 62 defining a substantially rectangular cross-sectional configuration for maintaining a substantially constant volumetric flow of stock through the tube 26 while increasing the velocity of the stock flow through the outlet end 62.

The slice chamber 30 also includes a plurality of trailing elements 64,65,66 and 67, as shown in FIG. 2. Each trailing element 64 to 67 has an end 68 which is pivotally secured to the downstream end 22 of the tube bank 18. Each trailing element 64 to 67 is pivotally secured to the tube bank 18 between adjacent rows of the plurality of rows 50 to 53, shown in FIG. 3.

Figure 5:
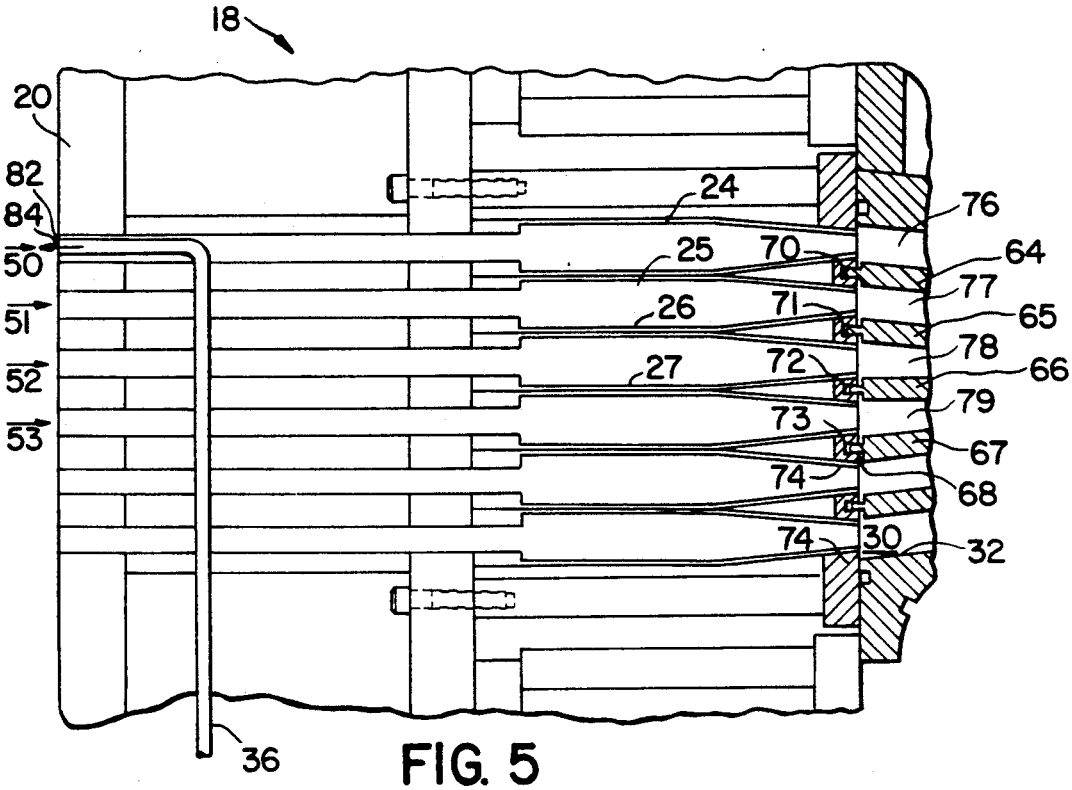
FIG. 5 is an enlarged sectional view taken on the line 5—5 of FIG. 3.

FIG. 5 is an enlarged sectional view of the tube bank 18 showing the tubes 24 to 27. The tube bank 18 defines a plurality of dove-tail shaped grooves 70,71,72 and 73, as shown in FIG. 5. Each groove 70 to 72 is disposed between adjacent rows 50,51; 51,52; 52,53 of the plurality of rows 50 to 53.

Each trailing element, for example element 67, defines in the vicinity of the pivotally secured end 68 an enlargement 74 which cooperates with one of the grooves 74 for pivotally anchoring the element 67 within the groove 74 such that the stock S flowing through the upstream extremity 32 of the slice chamber 30 is separated into a plurality of streams 76,77,78 and 79 partitioned from each other by the plurality of elements 64 to 66.

The slice chamber 30 converges in a direction from the upstream extremity 32 to the downstream extremity 34 such that the plurality of stream 76 to 79 within the slice chamber 30 converge relative to each other.

As shown in FIGS. 2 and 3, the plurality of supply conduits 36,37 extend through the tube bank 18. The arrangement is such that the conduit 36 is disposed immediately upstream relative to the tube 24.

Each supply conduit, for example conduit 36, extends through the tube bank 18 between adjacent tubes 24 and an upstream tube 80 of row 50. The conduit 36 has a termination 82 which is disposed closely adjacent to and upstream relative to the adjacent tube 24 of the plurality of tubes 24 to 27. The termination 82 is disposed adjacent to the upstream end 20 of the tube bank 18.

The stock diluting source 38 is fresh water or white water removed from the stock through the forming wire 12 and clarified. The water flows through the termination 82 such that the water mingles with and dilutes the stock S flowing through the adjacent tube 24 without changing the flow rate through the adjacent tube 24.

More specifically, the flow of water through the termination 82, as indicated by the arrow 84, is substantially normal to the direction of flow, as indicated by the arrow 86 shown in FIG. 3, of stock S past the termination 82 towards the adjacent tube 24.

The control means 40 includes a plurality of flow control valves 88 and 89 shown in FIG. 3. Each valve, for example valve 88, cooperates with a conduit 36 of the plurality of supply conduits 36 to 37 such that each of the supply conduits 36 to 37 is selectively connected to the stock diluting source 38 for varying the basis weight of the resultant web in a cross-machine direction without changing the flow rate through the tube bank 18.

Figure 6:
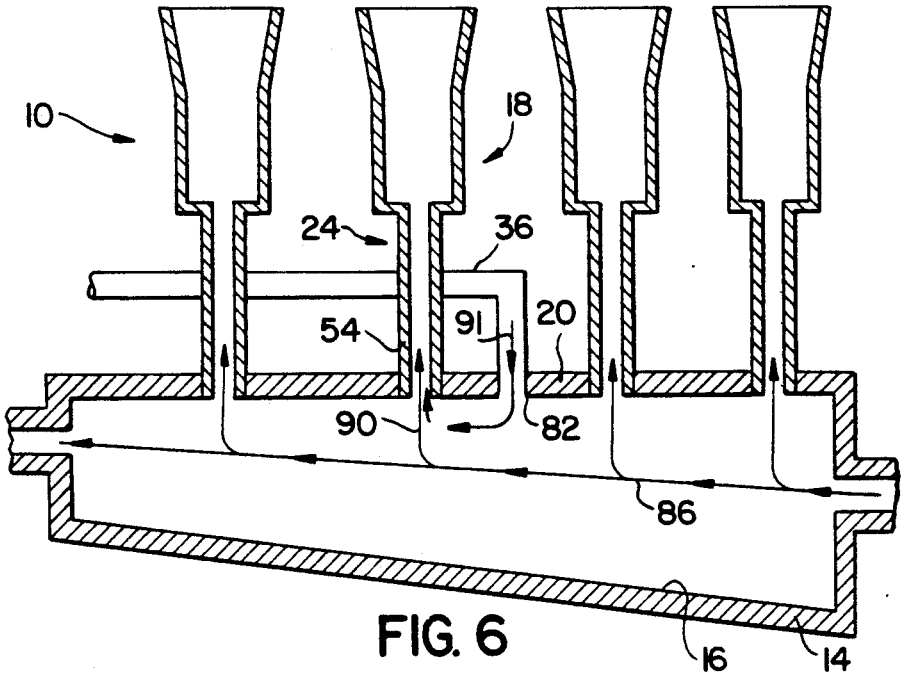
FIG. 6 is a diagrammatic representation of the tapered inlet shown in FIG. 2.

FIG. 6 is a diagrammatic representation of the headbox apparatus 10 according to the present invention showing the operation of the apparatus for controlling dilution of the stock flowing through at least some of the tubes of the tube bank 18.

The stock flows through the tapered inlet 16 of the housing 14. The flow of stock is indicated by the arrow 86. A portion, as indicated by the arrow 90, flows through the upstream portion 54 of the tube 24. A supply conduit 36 is connected to the upstream end 20 of the tube bank 18 so that the conduit 36 has a termination 82. The arrangement is such that water flows, as indicated by the arrow 91, substantially normal to the flow of stock 86. The flow 91 and 86 mingle together so that substantially all of the water entering through termination 82 flows with the portion of stock 90 through the upstream portion 54 of the tube 24. Consequently, the stock flowing through tube 24 is diluted. Therefore, the basis weight of the resultant web formed downstream on the forming wire is controlled in a cross-machine direction. More specifically, by such dilution, a sheet having a more uniform basis weight is achieved.

The present invention provides an accurate means for controlling and maintaining a substantially constant basis weight of a web in a cross-machine direction by dilution of stock flowing through a tube bank.

What is claimed is:

1. A headbox apparatus for electing stock onto a forming wire for forming a web, said apparatus comprising:

a housing connected to a pressurized source of the stock, said housing defining a tapered inlet for the flow therethrough of the stock;

a tube bank having an upstream and a downstream end, said upstream end of said tube bank being connected to said tapered inlet such that the stock flows at a substantially constant flow rate through said inlet and through said upstream end of said tube bank to said downstream end of said tube bank;

said tube bank including:

a plurality of tubes for the flow therethrough of the stock;

a member defining a slice chamber, said slice chamber having an upstream extremity and a downstream extremity, said upstream extremity being connected to said downstream end of said tube bank, said downstream extremity being disposed adjacent to the forming wire such that the stock flows through said downstream end of said tube bank and through said upstream extremity of said slice chamber so that the stock is ejected from said downstream extremity of said slice chamber onto the forming wire;

a plurality of supply conduits connected to said upstream end of said tube ban, each supply conduit of said plurality of supply conduits being connected to a stock diluting source for permitting dilution of the stock flowing into said tube bank;

control means cooperating with said supply conduits for controlling said dilution of the stock flowing through at least some of said tubes of said tube bank, said control means structured and arranged for controlling the cross-machine directional basis weight of the resultant web;

each supply conduit extending through said tube bank between adjacent tubes, each conduit having a termination disposed closely adjacent to and upstream relative to an adjacent tube of said plurality of tubes, said termination being disposed adjacent to said upstream end of said tube bank;

said stock diluting source being white water removed from the stock through the forming wire and clarified, said clarified white water flowing through said termination such that said clarified white water mingles with and dilutes the stock flowing through said adjacent tube without changing the flow rate through said adjacent tube;

each said supply conduit and respective termination being structured and arranged such that said flow of white water through said termination is substantially normal to the flow of stock past said termination towards said adjacent tube.

2. A headbox apparatus as set forth in claim 1, wherein said tapered inlet is tapered in a cross-machine direction such that the cross-sectional area for the flow therethrough of the stock progressively varies in a cross-machine direction.

3. A headbox apparatus as set forth in claim 2, wherein said housing includes an upstream and a downstream port in fluid communication with said tapered inlet, said upstream port being connected to said pressurized source of the stock, said cross-sectional area of said tapered inlet being inversely proportional to the distance from said upstream port.

4. A headbox apparatus as set forth in claim 1, wherein said tube bank further includes:

a frame for mechanically supporting said plurality of tubes such that the stock flowing through said inlet and through said upstream end of said tube bank flows through said plurality of tubes.

5. A headbox apparatus as set forth in claim 4, wherein said plurality of tubes are rigidly supported by said frame, said tubes being arranged in vertically spaced rows, each tube within each row being vertically aligned relative to a tube of an adjacent row.

6. A headbox apparatus as set forth in claim 1, wherein each tube of said plurality of tubes includes an upstream and a downstream portion, said upstream portion defining a substantially circular section taken in a direction normal to the direction of flow of the stock, said downstream portion having an initial end of circular cross-sectional configuration and an outlet end defining a substantially rectangular cross-sectional configuration for maintaining a substantially constant volumetric flow of stock through said tube while increasing the velocity of the stock flow through said outlet end.

7. A headbox apparatus as set forth in claim 1, wherein:

each tube of said plurality of tubes is arranged in a plurality of vertically spaced rows;

said slice chamber further including:

a plurality of trailing elements, each trailing element of said plurality of trailing elements having an end which is pivotally secured to said downstream end of said tube bank, each trailing element being pivotally secured to said tube bank between adjacent rows of said plurality of rows.

8. A headbox apparatus as set forth in claim 7, wherein:

said tube bank defines a plurality of dove-tail shaped grooves, each groove being disposed between adjacent rows of said plurality of rows;

each trailing element defining in the vicinity of said pivotally secured end thereof an enlargement which cooperates with one of said grooves for pivotally anchoring said element within said groove such that the stock flowing through said upstream extremity of said slice chamber is separated into a plurality of streams partitioned from each other by said plurality of trailing elements.

9. A headbox apparatus as set forth in claim 8, wherein said slice chamber converges in a direction from said upstream extremity to said downstream extremity such that said plurality of streams within said slice chamber converge relative to each other.

10. A headbox apparatus as set forth in claim 1, wherein said control means includes:

a plurality of flow control valves, each valve of said plurality of valves cooperating with a conduit of said plurality of supply conduits such that each of said supply conduits is selectively connected to said stock diluting source for varying the basis weight of the resultant web in a cross-machine direction without changing the flow rate through said tube bank.

* * * * *

UNITED STATES PATENT AND TRADEMARK OFFICE

CERTIFICATE OF CORRECTION

PATENT NO. : 5,196,091

DATED : 3/23/93

INVENTOR(S) : Richard E. Hergert

It is certified that error appears in the above-identified patent and that said Letters Patent is hereby corrected as shown below:

Column 2, line 60, "1988" should read --1968--.

Column 2, line 61, "issued" should be deleted.

Column 8, (claim 1) line 9, "ban" should read --bank--.

Signed and Sealed this

Thirtieth Day of November, 1993

Bruce Lehman

*Attest:*

BRUCE LEHMAN

*Attesting Officer*

*Commissioner of Patents and Trademarks*